US009021724B2

(12) United States Patent
Svitok

(10) Patent No.: US 9,021,724 B2
(45) Date of Patent: May 5, 2015

(54) METHOD FOR PUTTING INTO OPERATION A CLEARING APPARATUS SUITABLE FOR PICKING UP BALLAST

(75) Inventor: Vladimir Svitok, Ecublens (CH)

(73) Assignee: Matisa Materiel Industriel SA, Crissier (CH)

( * ) Notice: Subject to any disclaimer, the term of this patent is extended or adjusted under 35 U.S.C. 154(b) by 346 days.

(21) Appl. No.: 13/371,885

(22) Filed: Feb. 13, 2012

(65) Prior Publication Data

US 2012/0216433 A1 Aug. 30, 2012

(30) Foreign Application Priority Data

Feb. 11, 2011 (CH) ..... 245/11

(51) Int. Cl.
*E01B 27/04* (2006.01)
*E01B 29/13* (2006.01)

(52) U.S. Cl.
CPC ..... *E01B 27/04* (2013.01); *E01B 29/13* (2013.01)

(58) Field of Classification Search
CPC ..... E01B 27/00; E01B 27/02; E01B 27/021; E01B 27/023; E01B 27/026; E01B 27/105; E01B 27/107; E01B 29/04; E01B 29/05; E01B 37/00; E01B 2203/022
USPC ..... 37/104, 105, 106, 107; 104/2, 7.3
See application file for complete search history.

(56) References Cited

U.S. PATENT DOCUMENTS

| | | | | | |
|---|---|---|---|---|---|
| 2,899,759 | A * | 8/1959 | Campbell | 37/104 |
| 3,850,251 | A | 11/1974 | Plasser et al. | |
| 4,063,516 | A * | 12/1977 | Theurer | 104/12 |
| 4,108,076 | A * | 8/1978 | Knape | 104/2 |
| 4,355,687 | A * | 10/1982 | Theurer et al. | 171/16 |
| 4,479,439 | A * | 10/1984 | Theurer et al. | 104/7.1 |
| 4,611,541 | A * | 9/1986 | Theurer | 104/2 |
| 4,742,628 | A * | 5/1988 | Cicin-Sain | 37/105 |
| 5,201,127 | A * | 4/1993 | Whitaker, Jr. | 37/107 |
| 5,511,485 | A * | 4/1996 | Romani et al. | 104/2 |
| 6,637,133 | B2 * | 10/2003 | Theurer et al. | 37/104 |

FOREIGN PATENT DOCUMENTS

| | | |
|---|---|---|
| AT | 317275 B | 8/1974 |
| AT | 370463 B | 4/1983 |

* cited by examiner

*Primary Examiner* — Robert Pezzuto
*Assistant Examiner* — Jessica H Lutz
(74) *Attorney, Agent, or Firm* — Laurence A. Greenberg; Werner H. Stemer; Ralph E. Locher

(57) ABSTRACT

A method puts into operation a clearing apparatus suitable for picking up ballast and is disposed in an endless configuration during employment so as to encircle a railroad track. The clearing apparatus has a horizontal cross-duct which, prior to a start of the employment, is intended to be positioned below the railroad track and connected, on the one hand, to a rising duct and, on the other hand, to a return duct of the clearing apparatus. The method includes displacing ties of the railroad track in a longitudinal direction of the railroad track to create a tie gap; lowering the cross-duct through the tie gap between two rails of the railroad track and transferred, below the ties, into a working position extending crosswise to the longitudinal direction of the railroad track; and connecting the cross-duct to the rising duct and to the return duct.

6 Claims, 2 Drawing Sheets

FIG. 1
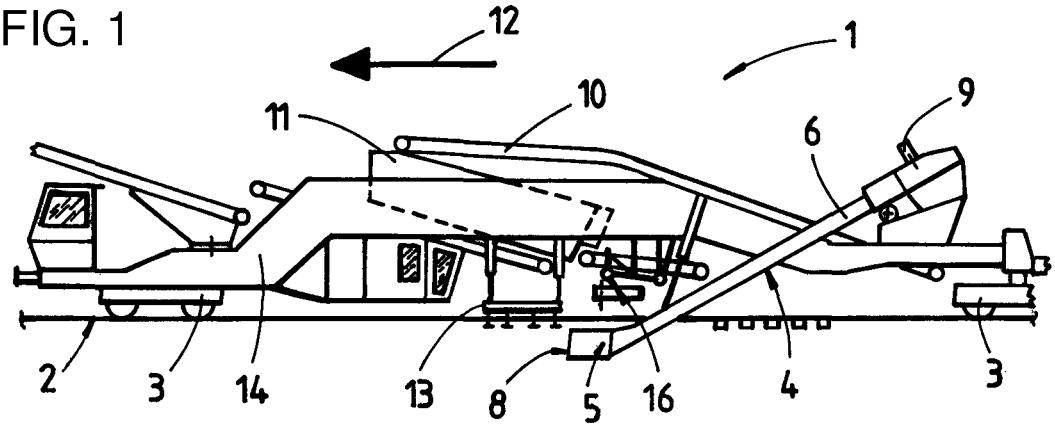
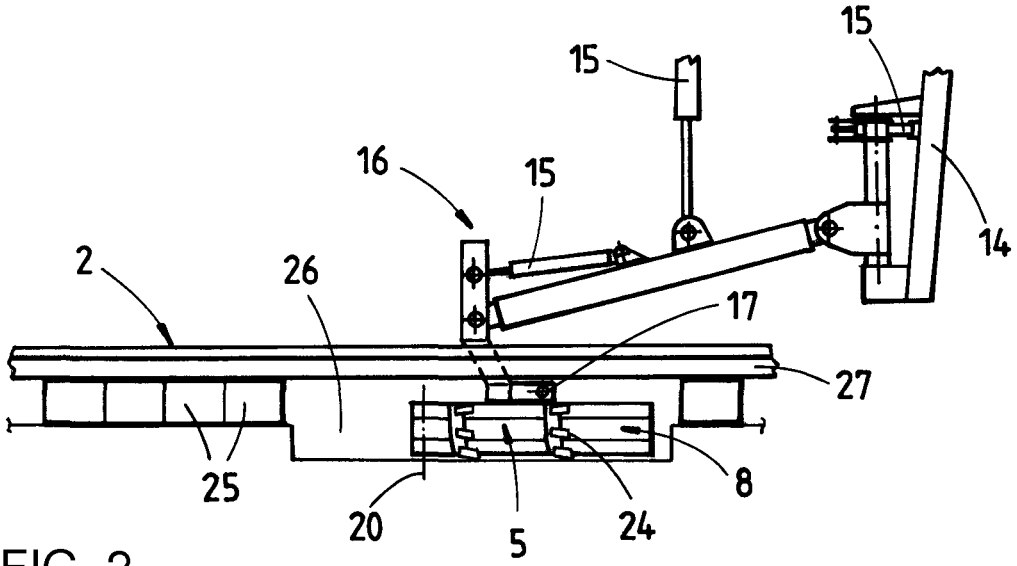
FIG. 2

FIG. 3
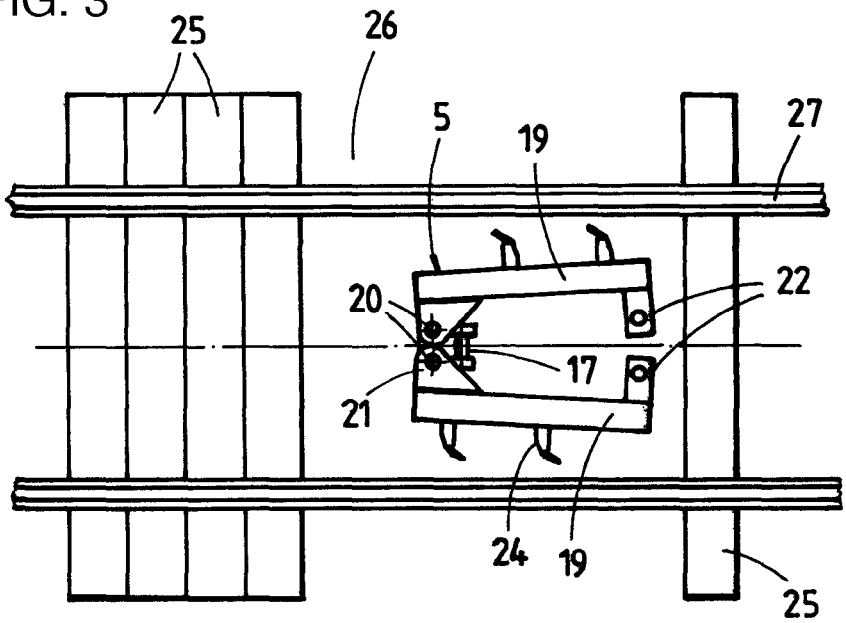
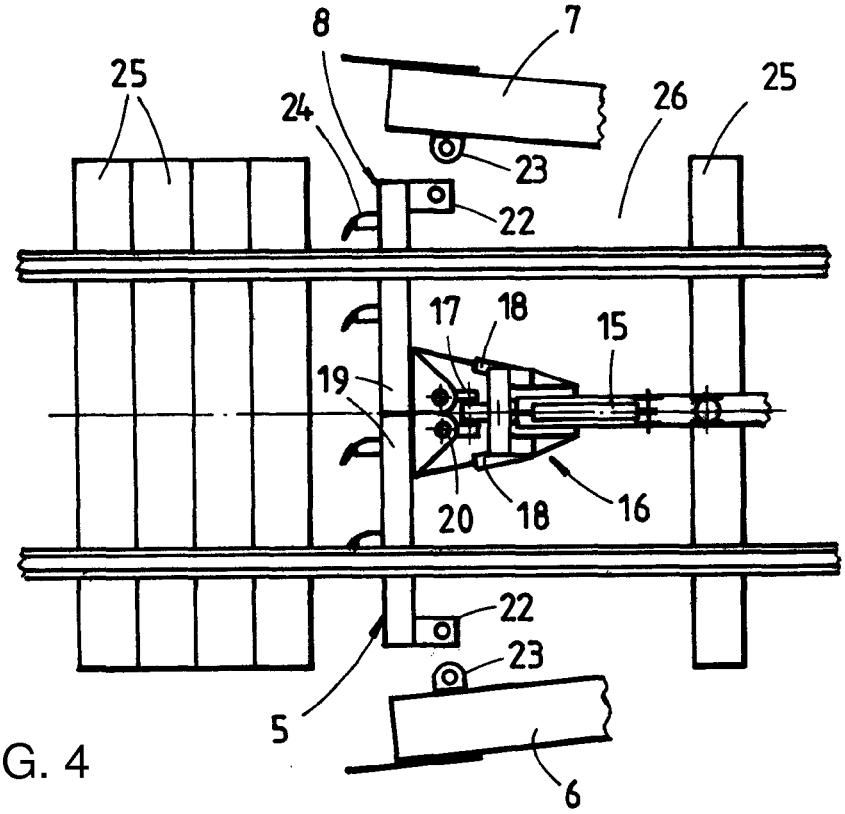
FIG. 4

METHOD FOR PUTTING INTO OPERATION A CLEARING APPARATUS SUITABLE FOR PICKING UP BALLAST

CROSS-REFERENCE TO RELATED APPLICATION

This application claims the priority, under 35 U.S.C. §119, of Swiss patent application CH 00245/11, filed Feb. 11, 2011; the prior application is herewith incorporated by reference in its entirety.

BACKGROUND OF THE INVENTION

Field of the Invention

The invention relates to a method for putting into operation a clearing apparatus which is suitable for picking up ballast and which is arranged in an endless configuration during employment so as to encircle a railroad track. The apparatus contains a horizontal cross-duct which, prior to the start of the employment, is intended to be positioned below the track and which is connected, on the one hand, to a rising duct and, on the other hand, to a return duct of the clearing apparatus. In addition, the invention also relates to a clearing apparatus.

Such a method is described in Austrian patent AT 370 463, for example and corresponding to U.S. Pat. No. 7,377,975. Since the clearing apparatus, which is configured to guide an endless clearing chain, encircles the track during employment, the preparation involved in putting the apparatus into operation is labor-intensive and associated with some problems. In order to guide the cross-duct into place, a duct-shaped recess must first be created in the ballast bed by removing ballast. The cross-duct must then be pushed under the track crosswise to the longitudinal direction of the track. This work has to be carried out manually or with the aid of crane-like lifting gear. In addition to the physically hard labor, another major problem is that, if the track is flanked by an adjacent track, the latter has to be closed down.

Austrian patent AT 317 275, corresponding to U.S. Pat. No. 3,850,251, also discloses a hinged cross-duct designed to allow rapid adaptation to the changing track width in the region of a switch. However, it is necessary to cut through the track in order to put the clearing apparatus into operation.

SUMMARY OF THE INVENTION

It is accordingly an object of the invention to provide a method for putting into operation a clearing apparatus suitable for picking up ballast and a clearing apparatus which overcomes the above-mentioned disadvantages of the prior art methods and devices of this general type, that make it possible to put a clearing apparatus into operation in a simplified manner while avoiding hard physical labor.

With the foregoing and other objects in view there is provided, in accordance with the invention a method for putting into operation a clearing apparatus suitable for picking up ballast and is disposed in an endless configuration during employment so as to encircle a railroad track. The clearing apparatus has a horizontal cross-duct which, prior to a start of the employment, is intended to be positioned below the railroad track and connected, on the one hand, to a rising duct and, on the other hand, to a return duct of the clearing apparatus. The method includes displacing ties of the railroad track in a longitudinal direction of the railroad track to create a tie gap; lowering the cross-duct through the tie gap between two rails of the railroad track and transferred, below the ties, into a working position extending crosswise to the longitudinal direction of the railroad track; and connecting the cross-duct to the rising duct and to the return duct.

As far as putting the clearing apparatus into operation is concerned, the invention now makes it possible to concentrate solely on the region situated between the two rails of the track. This allows the lowering of the cross-duct to proceed in a simpler manner and relatively simply from a mechanical point of view, without requiring the physical intervention of an operative for this purpose. A further particular advantage can also be afforded by the fact that it is possible to transfer the cross-duct into the working position wholly within the clearance profile without any problem. There is thus no need to close down a flanking adjacent track. The aforementioned advantages also fully apply in the case of returning the cross-duct into an inoperative position.

Other features which are considered as characteristic for the invention are set forth in the appended claims.

Although the invention is illustrated and described herein as embodied in a method for putting into operation a clearing apparatus suitable for picking up ballast and a clearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a diagrammatic, simplified side view of a track-working machine for ballast cleaning with a clearing apparatus having a cross-duct according to the invention;

FIG. 2 is a diagrammatic, side view of the cross-duct; and

FIGS. 3 and 4 are plan views of the cross-duct.

DETAILED DESCRIPTION OF THE INVENTION

Referring now to the figures of the drawing in detail and first, particularly, to FIG. 1 thereof, there is shown a track-working machine 1 for cleaning ballast of a track 2 which contains a clearing apparatus 4 between two rail bogies 3. The apparatus is composed of a cross-duct 5, which is situated below the track 2 in a working position, and a rising and return duct 6, 7 each connected thereto. There is thus formed an endless duct for guiding a clearing chain 8 (see FIGS. 2 to 4) which can be rotated by a drive 9. The clearing apparatus 4 is assigned a conveyor belt 10 and a screening unit 11. As viewed directly upstream of the clearing apparatus 4 relative to a working direction 12, a track-lifting apparatus 13 is connected to a machine frame 14.

As can be seen particularly in FIGS. 1 and 2, a lowering apparatus 16 is connected to the machine frame 14, the lowering apparatus 16 being displaceable, by drives 15, from an overhead position (FIG. 1) into a lowered position (FIG. 2) below the track 2 and being able to be detachably connected to the cross-duct 5 by a coupling 17.

As can be seen in FIG. 4, the lowering apparatus 16 is equipped with pivoting drives 18 for moving two duct parts 19 of the cross-duct 5 about an axis 20 of a hinge 21 (FIG. 3), each of the aforementioned pivoting drives 18 being detachably connected to one duct part 19. The cross-duct 5 has two spaced-apart couplings 22 which are each assigned to one end and which can be connected to couplings 23 of the rising and return ducts 6, 7. Chain members 24 forming part of the clearing chain 8 are located in the cross-duct 5.

The method according to the invention for putting the clearing apparatus 4 into operation will now be described in more detail below. During the travel of the track-working machine 1 to the track-working site, the cross-duct 5 is connected to the lowering apparatus 16 and is situated above the track 2. At the beginning of the ballast section which is to be cleaned, and with the required amount of ballast having been excavated, adjacent ties 25 of the track 2 are displaced in the longitudinal direction of the track such that a tie gap 26 results.

The cross-duct 5, which is folded up according to FIG. 3, is then lowered between two rails 27 of the track 2 through the tie gap 26 using the lowering apparatus 16 (not shown in FIG. 3 for the sake of clarity). Below the ties 25 the two duct parts 19 are transferred, under the action of the pivoting drives 18 (FIG. 4), into a working position extending crosswise to the longitudinal direction of the track. The next step is to connect the cross-duct 5 to the rising duct 6 and to the return duct 7 using the couplings 22, 23. Then, by remotely actuating the coupling 17 (and disconnecting the pivoting drives 18), the lowering apparatus 16 can be detached from the cross-duct 5 and raised into the inoperative position illustrated in FIG. 1. That part of the clearing chain 8 situated in the cross-duct 5 has to be connected to the sections situated in the ducts 6, 7.

The return of the cross-duct 5 into the overhead position (FIG. 1) takes place analogously but in reverse order using the lowering apparatus 16.

As an alternative to the method just described, it would also be possible within the context of the invention, given a correspondingly longer formation of the tie gap 26, for a cross-duct 5 of one-part design to be transferred into the working position between the two rails 27 and the spaced-apart ties 25. All that is required to achieve this is, with the aid of the lowering apparatus, to rotate the cross-duct from an overhead position extending at an acute angle to the longitudinal direction of the track into the working position extending crosswise below the ties 25.

The invention claimed is:

1. A method for putting into operation a clearing apparatus suitable for picking up ballast and disposed in an endless configuration during employment so as to encircle a railroad track, the clearing apparatus having a lowering apparatus fastened to a machine frame, a rising duct, a return duct, and a horizontal cross-duct which, prior to a start of the employment, is intended to be positioned below the railroad track and connected to the rising duct and to the return duct of the clearing apparatus, wherein the cross-duct has a hinge for pivoting in a horizontal plane between the two connections and a detachable third connection to the lowering apparatus, and wherein an endless clearing chain having a multiplicity of chain members is accommodated in and guided by the cross-duct, the method which comprises the steps of:

displacing ties of the railroad track in a longitudinal direction of the railroad track to create a tie gap;

lowering the cross-duct through the tie gap between two rails of the railroad track and transferring the cross-duct, below the ties, into a working position extending crosswise to the longitudinal direction of the railroad track; and connecting the cross-duct to the rising duct and to the return duct.

2. The method according to claim 1, which further comprises folding up the cross-duct, which is made up of two hinged-together duct parts, in a horizontal plane prior to being guided through the tie gap and folding the cross-duct apart into the working position after having been guided through the tie gap.

3. The method according to claim 2, wherein after being guided through the tie gap, the cross-duct is rotated about a vertical axis into the working position.

4. The method according to claim 1, which further comprises removing, prior to the cross-duct being guided through the tie gap, the ballast situated below the tie gap.

5. A clearing apparatus for picking up track ballast and supported on a machine frame of a track-working machine, the clearing apparatus comprising:

a lowering apparatus to be fastened to the machine frame;

a rising duct;

a return duct;

a cross-duct to be positioned below a railroad track and having, two duct parts and two spaced-apart coupling ends which can be connected to said rising duct and to said return duct, said cross-duct having, between said two spaced-apart couplings, a hinge for pivoting said two duct parts in a horizontal plane, said cross-duct further having a third coupling for detachable connection to said lowering apparatus; and an endless clearing chain having a multiplicity of chain members accommodated in and guided by said cross-duct.

6. The clearing apparatus according to claim 5, wherein said lowering apparatus has pivoting drives for moving said two duct parts of said cross-duct about an axis of said hinge, wherein each of said pivoting drives is detachably connected to one of said duct parts being a chain duct.

* * * * *